US007392617B2

(12) United States Patent
Wallerstorfer et al.

(10) Patent No.: US 7,392,617 B2
(45) Date of Patent: Jul. 1, 2008

(54) ROTATING BARRIER

(75) Inventors: Kurt Wallerstorfer, Irrsdorf (AT); Gregor Ponert, Salzburg (AT)

(73) Assignee: SkiData AG, Gartenau (AT)

( * ) Notice: Subject to any disclaimer, the term of this patent is extended or adjusted under 35 U.S.C. 154(b) by 190 days.

(21) Appl. No.: 11/157,209

(22) Filed: Jun. 20, 2005

(65) Prior Publication Data

US 2006/0000144 A1 Jan. 5, 2006

(30) Foreign Application Priority Data

Jun. 21, 2004 (EP) ..... 04014525

(51) Int. Cl.
*E06B 11/08* (2006.01)

(52) U.S. Cl. ..... 49/47; 49/46; 49/25

(58) Field of Classification Search ..... 49/42, 49/46, 47, 25

See application file for complete search history.

(56) References Cited

U.S. PATENT DOCUMENTS 3,609,914 A * 10/1971 Berl ..... 49/5
3,998,008 A * 12/1976 Collins ..... 49/47
4,020,927 A * 5/1977 Collins ..... 188/184
5,056,261 A * 10/1991 Tetherton ..... 49/47
6,012,252 A 1/2000 Kocznar et al.
6,044,586 A * 4/2000 Wotke ..... 49/47
6,170,194 B1 1/2001 Kocznar et al.

FOREIGN PATENT DOCUMENTS

| | | |
|---|---|---|
| AT | 006 665 U1 | 12/2003 |
| EP | 0804676 B1 | 4/2002 |
| EP | 1 416 116 B1 | 5/2004 |

* cited by examiner

*Primary Examiner*—Jerry Redman
(74) *Attorney, Agent, or Firm*—Flynn, Thiel, Boutell & Tanis, P.C.

(57) ABSTRACT

A rotating barrier for a gateway (5) has a rotatable blocking element (2) having a single blocking arm (1) which blocks the gateway (5) in the blocking position and is rotated between the blocking positions by 360° in each case. Further provided are an access authorization reader (7) and a people sensor (8) whose detection area (9) is located in front of the blocking arm (1) in the blocking position thereof.

15 Claims, 1 Drawing Sheet

ROTATING BARRIER

FIELD OF THE INVENTION

This invention relates to a rotating barrier having a blocking element.

BACKGROUND OF THE INVENTION

A rotating barrier is known from EP 804676 B1. The detection area of the disclosed people sensor is located accordingly behind the blocking arm when the arm is in its blocking position. Compared to a conventional rotating barrier with three blocking arms, the single blocking arm substantially improves the comfort when passing, in particular when one is carrying objects such as skis, ski poles, bags and the like. However, it is disadvantageous that after the first partial rotation of the blocking arm to the release position, which has been triggered by a valid access authorization, a following person without access authorization, can pass through the gateway along with the preceding person before the gateway is blocked again by the second partial rotation of the blocking arm. To remedy this, EP 804676 B1 proposes making the rotation angle of the second partial rotation quite short, i.e. no more than 90°, and increasing the rotational speed during the second partial rotation. However, a small rotation angle from the release position to the blocking position has the consequence that the blocking arm protrudes far into the gateway in the release position, thereby at least partly destroying the comfort when passing that a single blocking arm basically has. If the user authorized to pass walks too slowly or actually stops when passing the people sensor, an increase in rotational speed upon upward rotation of the blocking arm out of the release into the blocking position results at least in a painful blow.

So as not to impair the comfort when passing of a rotating barrier having only one blocking arm, AT 6665 U1 proposes that the blocking arm completely releases the gateway in its basic position, but the passage authorization reader and the people sensor are disposed in front of the blocking arm, so that when the people sensor detects a person but no valid passage authorization is read, the blocking arm is swiveled into the blocking position. For this purpose the passage authorization reader and the people sensor must be disposed at an accordingly great distance in front of the turnstile. A person who has passed the passage authorization reader without authorization can thus wait in front of the blocking arm then blocking the gateway until the gateway is released by a following person with valid passage authorization. Passing without valid passage authorization is thus even easier.

The problem of the invention is to provide a rotating barrier with high comfort when passing and reliable person singling.

SUMMARY OF THE INVENTION

According to the invention, the people sensor is disposed such that its detection area is in front of the blocking arm when the latter is in its blocking position. When the user's passage authorization has been read, the blocking arm thus swivels downward from the blocking position to the release position in a first partial rotation and is at once rotated upward again in a second partial rotation, so that there is no room for a following person to pass through the gateway without authorization together with the person authorized to pass.

The blocking arm can in fact come in contact with the user during the second partial rotation. However, if the rotational speed in the second partial rotation is not increased, this does not result in an impairment of comfort, even if the user walks very slowly. The torque is composed of the force and the lever arm. When the blocking arm is rotated upward out of its downward pointing release position, it first touches the slowly walking person at a large distance from its rotation axis, i.e. with a long lever arm, and thus only lightly. This light touching has the psychological effect of increasing the user's passing speed and thus decreasing the force that acts on the initially slowly walking user due to the blocking arm.

According to the invention, there is the possibility here of making the rotational speed in the second partial rotation lower in order to further reduce the force of the blocking arm acting on a slowly walking user, but without impairing the reliability of person singling.

Further, according to the invention, the rotation angle in the second partial rotation can be 120° or more, in particular about 180°. This prevents the blocking arm from protruding partly into the gateway in the release position and thus impairing the comfort when passing.

Preferably, the rotation axis of the blocking element is inclined relative to the horizontal by 30° to 40°, while the angle of the blocking arm relative to the rotation axis of the blocking element is preferably 40° to 50°. Thus, in its downward rotated release position the blocking arm can extend into the gateway at an angle of no more than 10° relative to the vertical, preferably even out of the gateway, i.e. obliquely downward away from the gateway. Thus, the room at the gateway can even increase in the release position of the rotating arm from its rotation axis downward, thereby obtaining a particularly comfortable passage.

The drive of the blocking element is preferably effected by an electromotor, but pneumatic actuation can e.g. also be provided.

The passage authorization reader is preferably formed by a non-contact-type reader, in particular for reading RFID transponders with passage authorization stored thereon. However, the passage authorization reader can also be an insert reader, for example for magnetic, bar code or similar cards. It is also possible to provide both a non-contact-type reader and an insert reader. The people sensor can be formed for example as an optoelectronic sensor.

BRIEF DESCRIPTION OF THE DRAWINGS

In the following, an embodiment of the inventive rotating barrier will be explained in more detail by way of example with reference to the enclosed drawings, in which.

DETAILED DESCRIPTION

Figure 1:
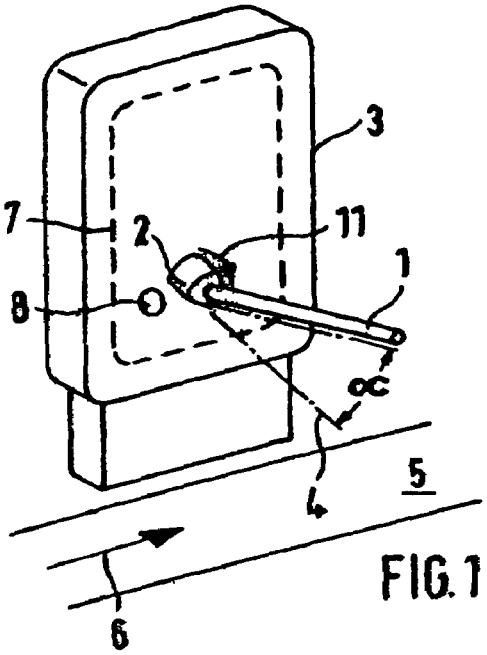
FIGS. 1 and 2 show perspective views of a rotating barrier with the blocking arm in the blocking position and release position, respectively.
Figure 2:
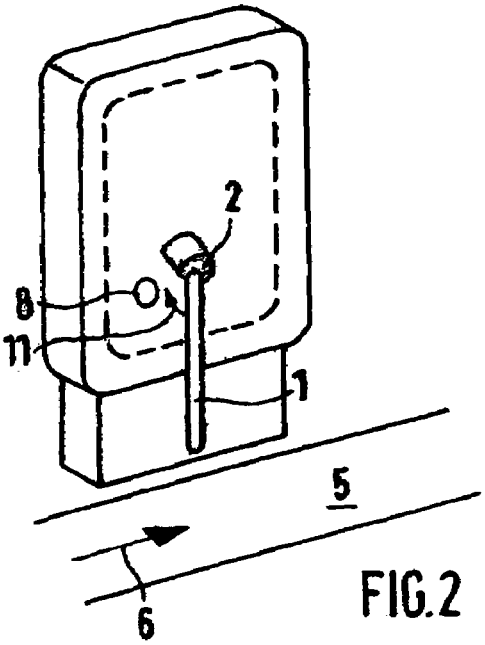
Figure 5:
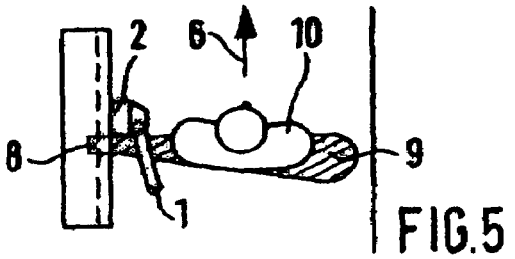

According to FIGS. 1 and 2, the rotating barrier has a blocking element 2 formed as a rotating member with, a blocking arm 1, said element being driven by a motor (not shown) in a housing 3. The rotation axis 4, shown by dashed lines, of the blocking element 2 is inclined downward from the horizontal by an angle $\alpha$ of about 35°. The angle that the rotation axis 4 encloses with the blocking arm 1 can be somewhat larger, being for example 45°.

While the blocking arm 1 assumes an approximately horizontal position and thus blocks the gateway 5 in the direction of the arrow 6 in the blocking position shown in FIG. 1, it is swiveled approximately vertically downward in the release position shown in FIG. 2.

The housing 3 also receives the other components, such as the mounting and the gearing and the electronics for operation of the motor and of the blocking element 2. The housing 3 further contains an antenna 7, shown by dashed lines, for an RFID reader module (not shown) for contactlessly reading the passage authorization stored in a transponder carried by the access-authorized user 10.

Figure 3:
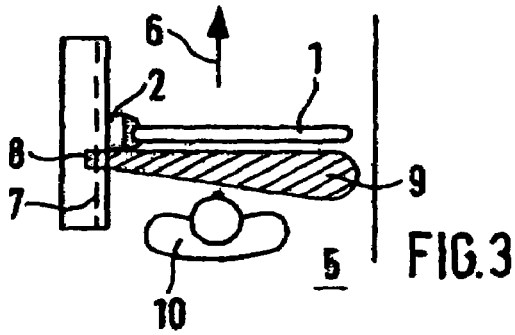
FIG. 3 shows a plan view of the rotating barrier in the blocking position before the gateway is passed.
Figure 4:
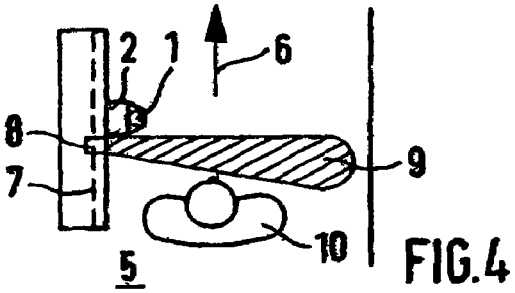
FIGS. 4 and 5 show plan views of the release position while the detection area of the people sensor is being passed.
Figure 6:
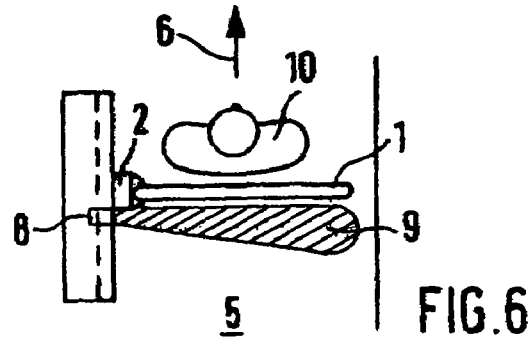
FIG. 6 shows a plan view after the gateway is passed.

Further, an optoelectronic people sensor 8 is provided in the housing 3 in front of the blocking element, its detection area 9 shown in FIGS. 3 to 6 being located in front of the blocking arm 1 in the transit direction 6 when said blocking arm is in the blocking position according to FIGS. 1, 3 and 6.

In the blocking position the blocking arm 1 protrudes approximately horizontally across the gateway 5. When the user 10 approaches the antenna 7 of the RFID reader module according to FIG. 3, the blocking arm 1 is swiveled, in case of valid passage authorization, out of its blocking position to the release position according to FIG. 4 and FIG. 2 in a first partial rotation of about 180° and thus the gateway 5 completely released. According to the arrow 11 in FIGS. 1 and 2, the blocking element 2 is thereby rotated with the blocking arm 1 clockwise, regarded from the gateway 5. When the blocking arm 1 has reached the release position according to FIGS. 2 and 4, the user 10 enters the detection area 9, so that immediately after the first partial rotation a second partial rotation of the blocking arm by about 180° begins (FIG. 5), thereby permitting the user 10 to pass through the gateway 5 without a person lacking passage authorization being able to push between him and the blocking arm 1.

For this purpose the drive of the blocking element 2 is activated so that the blocking arm 1 remains in the blocking position if a second person is ascertained in the detection area 9 of the people sensor 8 at the same time as a passage authorization is read by the passage authorization reader.

Since the blocking arm 1 is rotated upward again with the second partial rotation at once after reaching the release position, there is no room for a following person to pass through the gateway 5 without authorization together with the user 10 authorized to pass.

The invention claimed is:

1. A rotating barrier in combination with a gateway having an entrance side and an exit side, the rotating barrier comprising a blocking element which is rotatable by a drive around a downward inclined rotation axis and has a single blocking arm which blocks the gateway in a blocking position and is rotated 360° to return to the blocking position, an access authorization reader and a people sensor, wherein upon valid reading of a passage authorization by the access authorization reader the blocking arm is rotated from the blocking position downward to a release position in a first partial rotation and upon detection of the user by the people sensor the blocking arm is rotated in a second partial rotation to return to the blocking position, wherein a detection area of the people sensor is directed solely toward said entrance side when the blocking arm is in the blocking position.

2. A rotating barrier in combination with a gateway according to claim 1, wherein rotational speed of the blocking element is lower in the second partial rotation than in the first partial rotation.

3. A rotating barrier in combination with a gateway according to claim 1, wherein a rotation angle for the second partial rotation is greater than 120°.

4. A rotating barrier in combination with a gateway according to claim 1, wherein the blocking arm remains in the blocking position if a person is ascertained in the detection area of the people sensor at the same time as a valid reading of a passage authorization.

5. A rotating barrier in combination with a gateway according to claim 1, wherein the downward inclined rotation axis of the blocking element is inclined downwardly relative to the horizontal by 40° to 50°.

6. A rotating barrier in combination with a gateway according to claim 1, wherein an angle of the blocking arm is 40° to 50° relative to the rotation axis of the blocking element.

7. A rotating barrier in combination with a gateway according to claim 1, wherein in its downward rotated release position, the blocking arm extends into the gateway at an angle of no more than 10° relative to a vertical plane.

8. A rotating barrier in combination with a gateway having a path with an entrance side and an exit side to permit singling entry of persons, said barrier comprising:

a housing;

a rotatable blocking element projecting from said housing toward the path, said blocking element including a single blocking arm that is rotatable therewith, the blocking arm having a blocking position blocking the path and a release position enabling access via the path through said gateway;

a drive for rotating said blocking element to provide the blocking arm with a first partial rotation from the blocking position to the release position and for rotating said blocking element to provide said blocking arm with a second partial rotation from the release position to the blocking position, the first and second partial rotations equaling a complete 360 degree rotation of the blocking element;

a people sensor projecting from said housing for sensing the presence or absence of persons in a detection area within the path at the entrance side near said blocking element when the blocking element is in the blocking position; and an access authorization reader for reading a passage authorization from a person attempting to pass the barrier, wherein the single blocking arm rotates to the release position when the access authorization reader detects a valid passage authorization from a valid person traveling along the path at the same time that the people sensor ascertains the absence of a person in the detection area so that the valid person is able to pass through the barrier and, upon subsequent ascertaining of the presence of the valid person in the detection area, the single blocking arm rotates to the blocking position, and wherein the single blocking arm remains in the blocking position if the people sensor ascertains the presence of a person in the detection area of the path at the same time that the access authorization reader reads a passage authorization from a valid person traveling along the path to pass through the barrier.

9. The rotating barrier in combination with a gateway according to claim 8, wherein the drive provides a rotational speed for the second partial rotation that is lower than the rotational speed of the first partial rotation.

10. The rotating barrier in combination with a gateway according to claim 8, wherein the rotation angle of the second partial rotation is greater than 120 degrees.

11. The rotating barrier in combination with a gateway according to claim 8, wherein the rotatable blocking element has a downwardly inclined rotation axis.

12. The rotating barrier in combination with a gateway according to claim 11, wherein the blocking arm is oriented between 40 degrees and 50 degrees relative to the rotation axis.

13. The rotating barrier in combination with a gateway according to claim 12, wherein in the release position, the blocking arm extends into the path of the gateway at an angle of no more than 10 degrees relative to a vertical plane.

14. The rotating barrier in combination with a gateway according to claim 8, wherein the access authorization reader is mounted to said housing.

15. A rotating barrier in combination with a gateway having a path with an entrance side and an exit side to permit singling entry of persons, said barrier comprising:

a housing;

a rotatable blocking element projecting from said housing and having a downwardly inclined rotation axis, said blocking element including a single blocking arm that is rotatable therewith, the blocking arm having a blocking position blocking the path and a release position enabling access via the path through said gateway;

a drive for rotating said blocking element at a first rotational speed to provide the blocking arm with a first partial rotation from the blocking position to the release position and for rotating said blocking element at a second rotational speed that is lower than the first rotational speed to provide said blocking arm with a second partial rotation from the release position to the blocking position, the second partial rotation having an angle of greater than 120 degrees, the first and second partial rotations equaling a complete 360degree rotation of the blocking element;

a people sensor projecting from said housing, said people sensor sensing the presence or absence of persons in a detection area within the path at the entrance side near said blocking element when the blocking element is in the blocking position; and an access authorization reader for reading a passage authorization from a person attempting to pass the barrier, wherein the single blocking arm rotates to the release position when the access authorization reader detects a valid passage authorization from a valid person traveling along the path. at the same time that the people sensor ascertains the absence of a person in the detection area so that the valid person is able to pass through the barrier and, upon subsequent ascertaining of the presence of the valid person in the detection area, the blocking arm rotates to the blocking position, and wherein the single blocking arm remains in the blocking position if the people sensor ascertains the presence of a person in the detection area of the path at the same time that the access authorization reader reads a passage authorization from a valid person traveling along the path to pass through the barrier.

* * * * *